US006145216A

United States Patent [19]

Bauer

[11] Patent Number: 6,145,216

[45] Date of Patent: Nov. 14, 2000

[54] GLASS VIAL DRYER

[75] Inventor: Timothy J. Bauer, Warrington, Pa.

[73] Assignee: Merck & Co., Inc., Rahway, N.J.

[21] Appl. No.: 09/304,290

[22] Filed: May 3, 1999

Related U.S. Application Data

[60] Provisional application No. 60/084,902, May 11, 1998.

[51] Int. Cl.[7] ..... F26B 25/00

[52] U.S. Cl. ..... 34/105; 34/202; 34/237

[58] Field of Search ..... 34/90, 201, 202, 34/210, 215, 216, 237, 238, 104, 105, 106, 107

[56] References Cited

U.S. PATENT DOCUMENTS

| | | | |
|---|---|---|---|
| 2,884,708 | 5/1959 | Levitt | 34/237 |
| 2,897,973 | 8/1959 | Sizemore | 34/237 |
| 3,007,256 | 11/1961 | Rouy | 34/237 |
| 4,677,764 | 7/1987 | Cerny | 34/237 |
| 4,812,621 | 3/1989 | Brotherton et al. | 219/366 |
| 5,010,660 | 4/1991 | Hambleton et al. | 34/92 |

*Primary Examiner*—Pamela Wilson
*Attorney, Agent, or Firm*—Elliott Korsen; Mark R. Daniel

[57] ABSTRACT

A dryer for drying articles, such as vials of pharmaceutical bulk product, such as vaccines is disclosed. The dryer circulates ambient air through a plenum to evenly evaporate condensation on vials of pharmaceutical brought from refrigeration for labeling and further handling.

3 Claims, 2 Drawing Sheets

GLASS VIAL DRYER

This application claims benefit of Provisional Application Serial No. 60/084,902 filed May 11, 1998.

BACKGROUND OF THE INVENTION

This invention pertains to a vial dryer for rapidly drying glass vials, such as those used to store pharmaceutical bulk product. The dryer quickly evaporates condensation that forms on vials after removal from refrigeration for labeling and further handling.

Currently, vials of pharmaceutical bulk that require refrigeration are taken from cold storage prior to labeling. Upon removal, condensation forms on the vials which must be dried prior to labeling to ensure that the labels are applied properly and evenly. In the past, the vials were simply placed on tables for staging near the packaging machines and dried either with free standing or wall-mounted fans blowing air directly on the vials. Because some of the refrigerated bulk, such as vaccines, has limitations on the amount of time it can be out of refrigeration, waiting for the condensation to dry can result in lost or less potent product. Additionally, man-hours are lost when packaging machine operators are required to sit and wait for product to completely dry prior to labeling.

It has been found that a simple dryer can be used to quickly and efficiently dry the articles using ambient air to shorten the time needed outside of cold storage.

SUMMARY OF THE INVENTION

The present invention pertains to a vial dryer which comprises a rectangular drying plenum with a fan that effects drying of condensation by circulating ambient air through the plenum directly between the vials to be dried in order to rapidly and uniformly evaporate the condensation formed upon removal of the articles from a refrigerated environment to the ambient.

Accordingly, this invention provides a simple dryer that quickly, efficiently and economically dries condensation that forms on glass vials after the vials are removed from refrigeration.

This invention further provides a dryer that can use a standard wall outlet as a power source.

In accordance with these and other objects that shall become apparent hereinafter there is provided a dryer and method for using the dryer that circulates ambient air within the plenum of the dryer housing to uniformly dry articles within a tray situated on the housing. A tray or trays of vials are transferred from refrigeration to the dryer where ambient temperature air is circulated directly between the vials to rapidly and evenly evaporate condensation that forms when the refrigerated vials contact the warmer ambient air.

The instant invention will be more fully understood in the following detailed description, it being understood, however, that the invention is not confined to the precise disclosure. Changes and modification may be made that do not affect the spirit of the invention, nor exceed the scope thereof, as expressed in the appended claims. Accordingly, the instant invention will now be described with particular reference to the accompanying drawings.

DETAILED DESCRIPTION OF THE INVENTION

There is disclosed an apparatus for drying articles, such as pharmaceutical vials, which comprises a housing forming a drying chamber;

said housing being so constructed to include a fan for circulating ambient air within the chamber;

said chamber being open to receive a vial transfer tray containing vials in need of drying;

said tray having a bottom with an open lattice-like pattern to allow for uniform circulation of the air between the vials situated over the chamber;

whereby effecting drying of said vials;

said tray further comprises a removable U-shaped end piece being effective to evenly transfer the vials from the staging tray into the vial transfer tray, and to block the transferred vials from falling out of the tray during drying.

Figure 1:
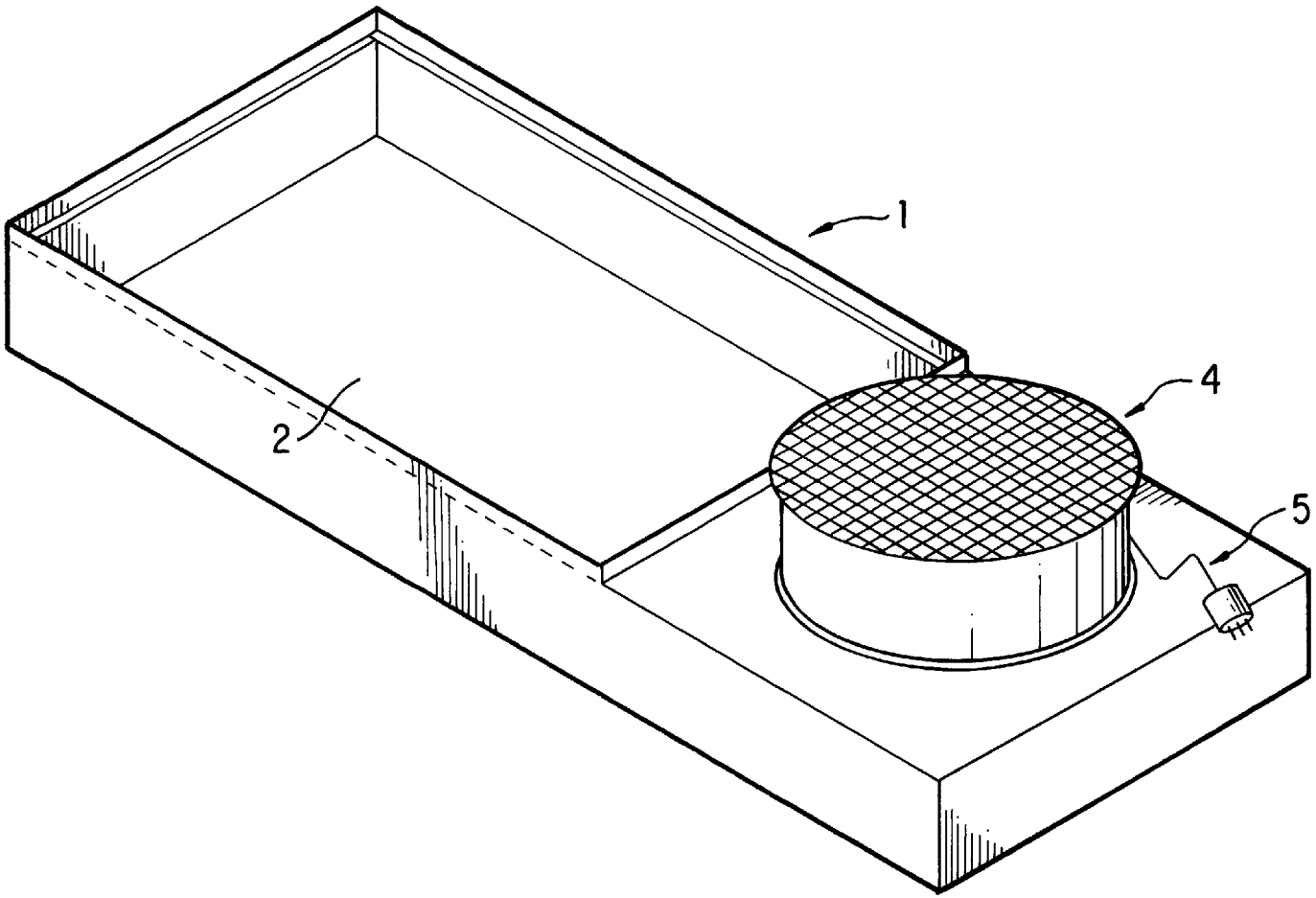
FIG. 1 shows an isometric view of the dryer showing the electric fan and open plenum area.
Figure 2:
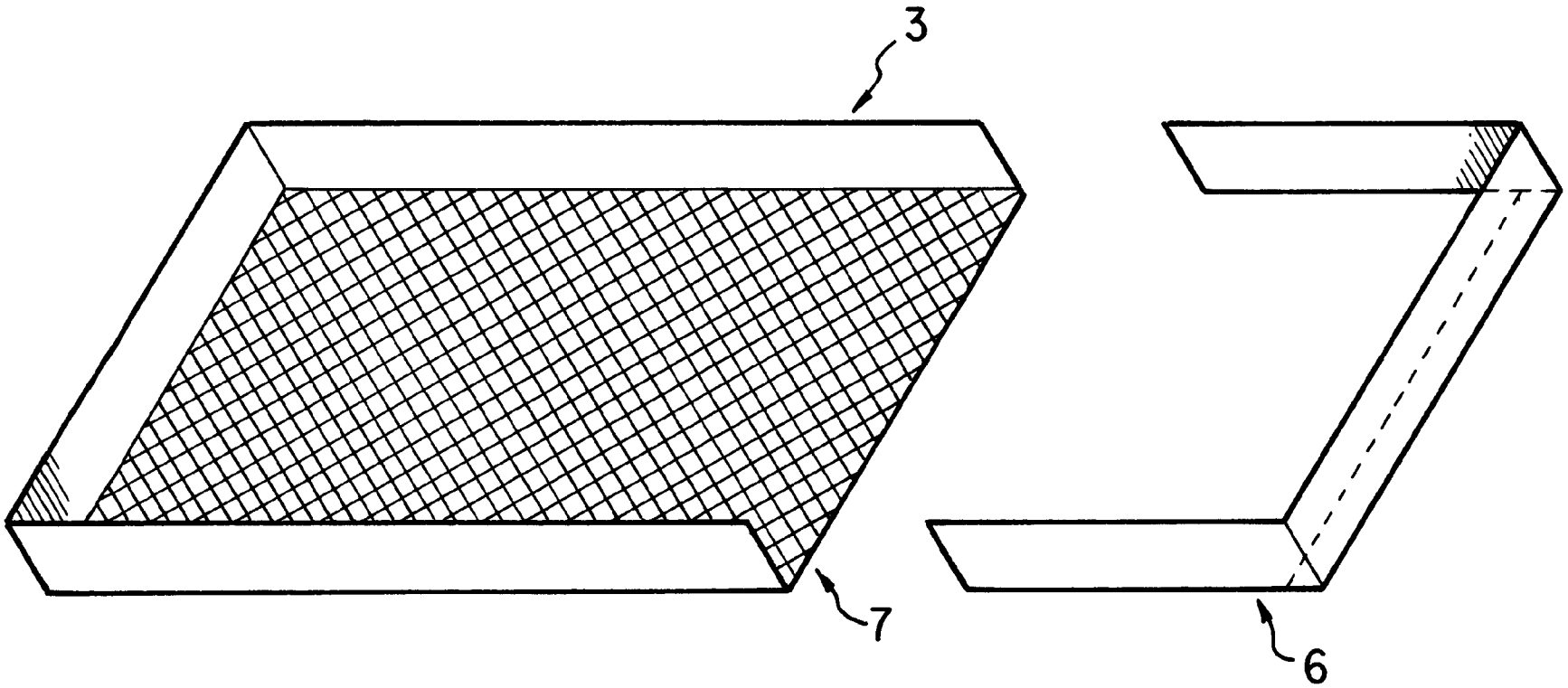
FIG. 2 shows an isometric expanded view of the vial transfer tray showing the three sided tray and end piece.

With reference to the drawings, in FIG. 1, there is disclosed a dryer assembly generally at 1. The assembly 1 has an open plenum area 2. Additionally, there is the fan 4 with power cord 5 adjacent to the chamber that circulates the ambient temperature air in order to effectuate the drying. As shown in FIG. 2, the vial transfer tray 3 is rectangular in shape with three attached walls. The fourth wall 6 is a removable U-shaped piece that allows for ease in sliding the vials from the trays in which they are stored when refrigerated onto the vial transfer tray. The bottom 7 of the vial transfer tray, as shown, is a lattice-like pattern to allow for the air that is blown into the plenum to flow evenly between the vials that are resting on the vial transfer tray.

The fan 4 can be any type of fan that fits within the dryer. Preferably, a 115 volt, 10" diameter axial fan with an aluminum housing and polycarbonate blade is used. The fan also has two conductor wires with ground.

The vial transfer tray and removable U-shaped piece can be composed of any metal, plastic or other material of construction to give them a rigid finish. A preferred material of construction is 316 gauge stainless steel.

The dryer of the invention can be removably mounted onto a movable cart in order to allow for movement of the dryer about the vial staging area.

In operation, vials are removed from refrigeration in cardboard trays. Using the special transfer tray, the vials are transferred to the drying tray and placed over the open plenum area. The fan is turned on and the ambient temperature air is circulated uniformly between the vials effecting the drying.

In one test of the dryer, test vials took approximately thirty minutes to air dry following removal from refrigeration while vials put in the dryer of the invention dried in less than ten minutes. The difference in staging time is dependent on the ambient temperature and humidity.

The principles, preferred embodiments and modes of operation of the present invention have been described in the foregoing specification. However, the invention which is intended to be protected is not to be construed as limited to the particular embodiments disclosed. The embodiments are to be construed as illustrative rather than restrictive. It is recognized, however, that departures may be made therefrom within the scope of the invention, and that obvious modifications may occur to a person skilled in the art, and that the metes and bounds of the invention are to determined solely from the appended claims.

What is claimed is:

1. An apparatus for drying articles, said apparatus comprising a housing forming a drying chamber;

said housing being so constructed to include a fan for circulating ambient air within the chamber;

said chamber being open to receive a vial transfer tray containing vials in need of drying;

said tray having a bottom with an open lattice-like pattern to allow for uniform circulation of the air between the vials situated over the chamber, whereby effecting drying of said vials.

2. The apparatus of claim 1 wherein the vial transfer tray further comprises a removable U-shaped end piece being effective to evenly transfer the vials from the staging tray into the vial transfer tray, and to block the transferred vials from falling out of the tray during drying.

3. The apparatus of claim 2 which is mounted upon a movable cart.

* * * * *